US006302188B1

(12) United States Patent
Ruhl et al.

(10) Patent No.: US 6,302,188 B1
(45) Date of Patent: Oct. 16, 2001

(54) MULTI-LAYER HEAT EXCHANGE BED CONTAINING STRUCTURED MEDIA AND RANDOMLY PACKED MEDIA

(75) Inventors: Andreas C. H. Ruhl; Edward G. Blazejewski, both of Green Bay, WI (US); William L. Thompson, Villa Park, CA (US)

(73) Assignee: Megtec Systems, Inc., DePere, WI (US)

( * ) Notice: Subject to any disclaimer, the term of this patent is extended or adjusted under 35 U.S.C. 154(b) by 0 days.

(21) Appl. No.: 09/067,967

(22) Filed: Apr. 28, 1998

(51) Int. Cl.[7] ..... F28D 17/00

(52) U.S. Cl. ..... 165/10; 165/902; 165/9.3; 60/299; 432/179

(58) Field of Search ..... 165/10, 104.16, 165/9.3, 9.4; 210/503; 431/2; 60/299; 432/179, 180, 181

(56) References Cited

U.S. PATENT DOCUMENTS

| | | | | |
|---|---|---|---|---|
| 1,522,111 | * | 1/1925 | Franck-Philipson | 60/299 |
| 1,825,259 | * | 9/1931 | Brassert | 165/9.3 |
| 1,964,830 | * | 7/1934 | Pohl et al. | 165/9.2 |
| 2,121,733 | | 6/1938 | Cottrell | 183/6 |
| 2,288,943 | * | 7/1942 | Eastman | 60/299 |
| 3,134,584 | * | 5/1964 | Agnew | 165/9.2 |
| 3,875,678 | | 4/1975 | Vits | 34/32 |
| 3,907,710 | | 9/1975 | Lundsager | 252/455 R |
| 4,124,357 | * | 11/1978 | Akimoto et al. | 60/299 |
| 4,140,467 | | 2/1979 | Ellison et al. | 432/72 |
| 4,206,553 | | 6/1980 | Ellison et al. | 34/28 |
| 4,346,753 | * | 8/1982 | Kletch | 165/9.1 |
| 4,405,010 | * | 9/1983 | Schwartz | 165/10 |
| 4,509,584 | * | 4/1985 | Michalak et al. | 165/10 |
| 4,510,263 | | 4/1985 | Pereira et al. | 502/314 |
| 4,519,442 | * | 5/1985 | Barna et al. | 165/9.2 |
| 4,541,995 | * | 9/1985 | Kim et al. | 60/299 |
| 4,541,996 | * | 9/1985 | Pereira et al. | 60/299 |
| 4,908,344 | * | 3/1990 | Pereira et al. | 502/313 |
| 4,942,676 | | 7/1990 | Wimberger et al. | 34/51 |
| 5,038,850 | * | 8/1991 | Choi | 165/10 |
| 5,174,044 | | 12/1992 | Jacobs et al. | 34/23 |
| 5,207,008 | | 5/1993 | Wimberger et al. | 34/23 |
| 5,210,961 | | 5/1993 | Jacobs et al. | 34/155 |
| 5,352,115 | | 10/1994 | Klobucar | 432/181 |
| 5,427,683 | * | 6/1995 | Gershon et al. | 210/503 |
| 5,441,097 | * | 8/1995 | Kanda et al. | 165/10 |
| 5,531,593 | | 7/1996 | Klobucar | 432/181 |
| 5,707,299 | | 1/1998 | Klobucar | 432/181 |
| 5,755,569 | | 5/1998 | Berg et al. | 432/181 |

FOREIGN PATENT DOCUMENTS

| | | |
|---|---|---|
| 0 326 227 | 8/1989 | (EP) . |
| 0 326 228 | 8/1989 | (EP) . |
| 0 346 041 | 12/1989 | (EP) . |
| 0 0 396 173 | 11/1997 | (EP) . |

OTHER PUBLICATIONS

Anthony Mills, Basic Heat and Mass Transfer, Richard Irwin Inc, pp625–627,634–638,289–294, 1995.*

* cited by examiner

*Primary Examiner*—Ira S. Lazarus
*Assistant Examiner*—Terrell McKinnon
(74) *Attorney, Agent, or Firm*—Mitchell D. Bittman; Kevin S. Lemack

(57) ABSTRACT

A heat exchanger for a regenerative thermal oxidizer is described which includes at least one heat exchange column provided with a multi-layer of packing material including at least one layer of randomly packed and specially shaped and sized particles, each particle being formed of a high temperature stable material and preferably having a cylindrical outer wall and internal reinforcing vanes extending from the cylindrical outer wall to the center of the particle, and at least one layer of structured monolithic media having a plurality of flow passages in the direction of gas flow through the column.

22 Claims, 6 Drawing Sheets

Teilo8E

QUADEICO8E

MULTI-LAYER HEAT EXCHANGE BED CONTAINING STRUCTURED MEDIA AND RANDOMLY PACKED MEDIA

BACKGROUND OF THE INVENTION

The present invention relates to heat exchange media in regenerative thermal oxidizers (RTOs). More particularly, the invention relates to heat exchange media for use in heat exchangers in RTOs, and the resulting improved thermal oxidizers.

Regenerative thermal oxidizers are preferably used for destroying volatile organic compounds (VOCs) in high flow, low concentration emissions from industrial and power plants. RTOs typically require high oxidation temperatures in order to achieve high VOC destruction and high heat recovery efficiency. To more efficiently attain these characteristics, the "dirty" process gas which is to be treated is preheated before oxidation. A heat exchanger column is typically provided to preheat these gases. The column is usually packed with a heat exchange material having good thermal and mechanical stability and high thermal mass. In operation, the process gas is fed through a previously heated heat exchanger column, which, in turn, heats the process gas to a temperature approaching or attaining its VOC oxidation temperature. This pre-heated process gas is then directed into a combustion chamber where VOC oxidation is usually completed.

The treated "clean" gas is then directed out of the combustion chamber and back through the heat exchanger column, or, according to a more efficient process, through a second heat exchange column. As the hot oxidized gas is fed through the column, the gas transfers its heat to the heat exchange media in the column, cooling the gas and preheating the heat exchange media so that another batch of process gas may be preheated prior to the oxidation treatment. Usually, an RTO has at least two heat exchanger columns which alternately receive process and treated gases. This process is continuously carried out, allowing a large volume of process gas to be efficiently treated.

The performance of an RTO may be optimized by increasing VOC destruction efficiency and by reducing operating and capital costs. The art of increasing VOC destruction efficiency has been addressed in the literature using, for example, means such as improved oxidation systems and purge systems. Operating costs can be reduced by increasing the heat recovery efficiency, and by reducing the pressure drop across the oxidizer. Operating and capital costs may be reduced by properly designing the RTO and by selecting appropriate heat transfer packing materials. While design aspects of RTOs have been the subject of prior patent literature, the choice of the heat transfer packing material has not been sufficiently addressed.

It is therefore an object of the present invention to provide an arrangement of heat exchange media which provides a significant high heat recovery by low pressure drop of an RTO, thereby reducing costs associated with the process.

The properties of a bed of packing material, such as the shape, size, and packing characteristics, determine the heat recovery, pressure drop, and cycle time of the RTO. For example, heat recovery is proportional to the heat transfer coefficient and the heat capacity per unit bed volume. Cycle time, like heat recovery, is proportional to the bed heat capacity per bed column. For a given packing material, heat capacity per bed volume is inversely proportional to bed void fraction. Pressure drop is also inversely proportional to the bed void fraction. Thus, in conventional bed packing materials, a higher bed void fraction decreases not only pressure drop (which reduces operating cost) but also decreases heat recovery and cycle time (which increases operating cost).

In order to obviate the problems associated with pressure drop, monolith structures have been proposed (see, e.g., U.S. Pat. No. 5,352,115 to Klobucar). Such structures, however, suffer from a decreased heat recovery. Further, the continuous structure of the Klobucar material renders it vulnerable to thermal stresses due to a thermal gradient from the inlet portion of the monolith to the outlet portion of the monolith. These stresses may cause cracking and premature failure of the monoliths resulting in costly, unscheduled downtime of the RTO and replacement of the monoliths. Monolith structures are also expensive.

A number of different shapes of packing materials have been disclosed in the prior art. As disclosed below, however, shapes have primarily been used as contacting or mixing devices and as catalyst pellets. The influence of the size and shape of the heat transfer material on the heat transfer, heat storage, and pressure drop in RTOs has not been discussed.

For example, U.S. Pat. No. 3,907,710 (Lundsager) discloses a four- and six-ribbed wagon wheel-shaped material. This material has been proposed as a contacting device in a packed tower or column or as an inert support on which catalytic ingredients may be deposited to perform catalytic reactions.

U.S. Pat. No. 4,610,263 (Pereira et al.) discloses an extrudate suitable for improved gas-liquid contacting which is made from a solid transitional alumina. This material has a similar shape to one of the materials disclosed in the present invention. The cylindrical extrudate has partially hollow interior and internal reinforcing wings extending from the inner wall to the center of the extrudate particle. The transitional alumina of the reference has a BET nitrogen surface area of at least 50 $m^2/g$, a diameter of up to about 6.5 mm, an aspect ratio of length to diameter of from 0.5 to 5, a geometric surface area of at least 25% greater than a hollow tube of the same inside and outside diameter, a porosity of at least 0.3 $cm^3/g$, and a surface area per reactor volume of at least 5 $cm^2/cm^3$.

In light of the foregoing, there is a need for low-cost and simple heat exchange media having excellent thermal and mechanical stability and high thermal mass which will not exhibit a large pressure drop when packed into heat exchange column for an RTO.

SUMMARY OF THE INVENTION

Accordingly, the present invention is directed to a heat exchanger utilizing a combination of structured heat exchange media and randomly packed particles to form a geometrically compacted bed having a highly effective thermal efficiency and a low pressure drop. The heat exchange material of the present invention includes material made of a high-temperature stable material such a mullite, alpha-alumina, silica-alumina, clay, or the like. The randomly packed portion of the media of this invention can be configured in various shapes, such as saddles or preferably "MINILITHS™" having specially shaped vanes extending from the center. One embodiment, a cylindrical particle, has a partially hollow interior with internal reinforcing vanes or ribs extending from the inner wall to the center of the extrudate particle. This configuration permits the media to have high strength and a large geometric surface area per heat exchanger volume which is required for efficient heat transfer. This media is used in combination with monolithic material. In view of the shape and size of the randomly packed media particles and their use in combination with structured media, the heat exchanger column packed therewith will not exhibit a large pressure drop and the heat capacity of these particles is greater than that of conventional extruded monoliths used alone. The multi-layer heat exchanger bed offers the advantage of reducing capital costs by maintaining the same bed height and the same highly effective thermal efficiency while accepting only minimal increased pressure drop compared to single layer beds of structured media (also see Table 1). Single layer randomly packed media have very high pressure drops.

Additional features and advantages of the invention will be set forth in the description which follows, and in part will be apparent from the description, or may be learned by practice of the invention. The objectives and other advantages of the invention will be realized and attained by the system, method and combination particularly pointed out in the written description and claims hereof as well as the appended drawings.

To achieve these and other advantages and in accordance with the purpose of the invention, as embodied and broadly described, the invention is a heat exchanger having at least one heat exchanger column provided with a bed of heat exchange media formed of a high temperature stable material that is a combination of randomly packed media and structured media.

In another aspect, the invention includes a method of exchanging heat by providing a gas through an inlet of a heat exchanger column, then passing gas through a bed of heat exchange media, the media being formed of a high temperature stable material that is a combination of randomly packed media and structured media.

In a still further aspect, the invention includes a combination of structured and randomly packed heat exchange media suitably sized so as to avoid large pressure drops while allowing for laminar flow and high heat transfer in the heat exchange column(s).

It is to be understood that both the foregoing general description and the following detailed description are exemplary and explanatory, and are not restrictive of the invention as claimed.

BRIEF DESCRIPTION OF THE DRAWINGS

The accompanying drawings which are incorporated in and constitute a part of this specification, illustrate embodiments of the invention and, together with the description, serve to explain the objects, advantages, and principles of the invention.

In the drawings.

DETAILED DESCRIPTION OF THE PREFERRED EMBODIMENTS

Figure 1:
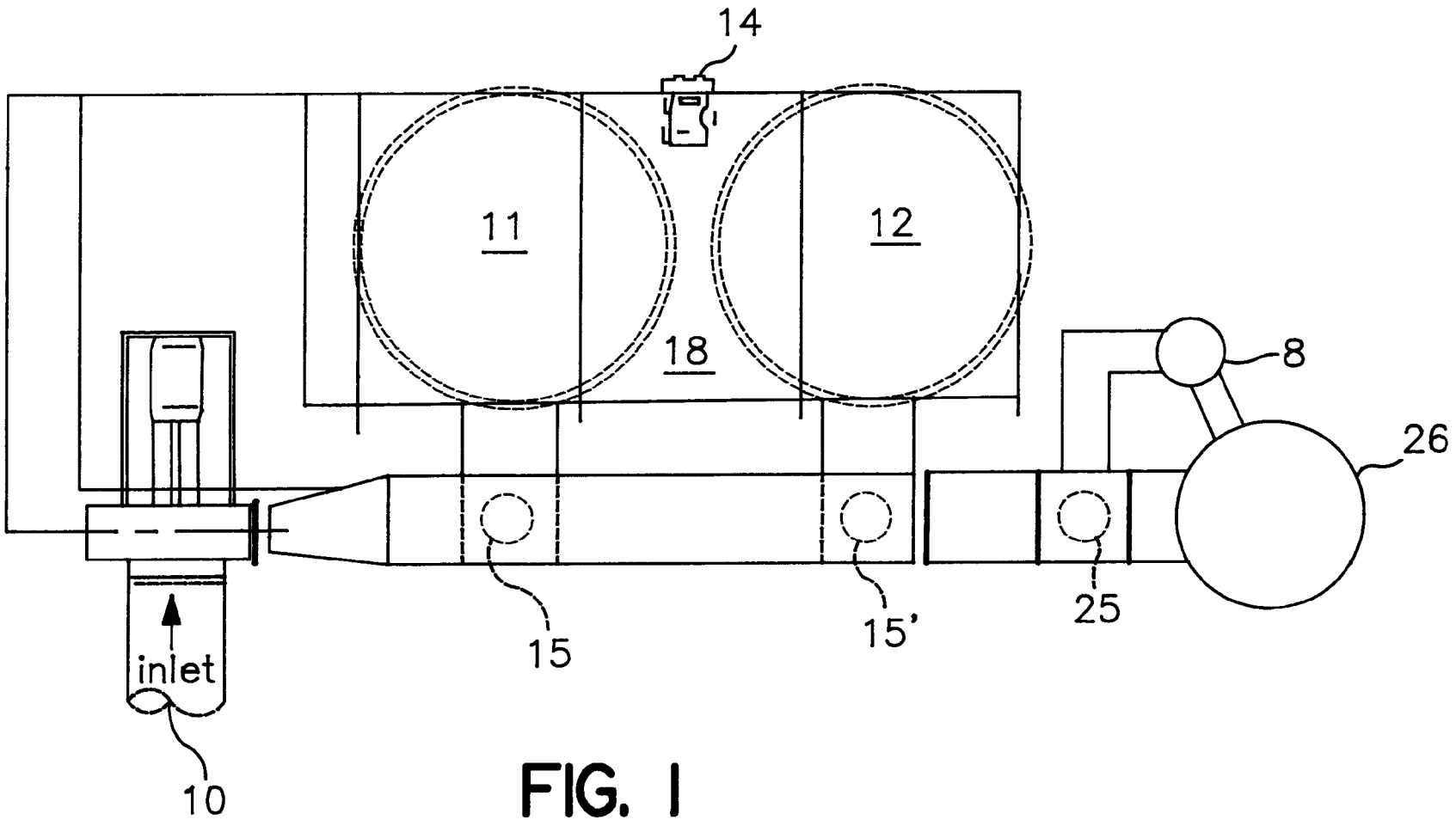
FIG. 1 is a top view of one embodiment of a regenerative thermal oxidizer utilizing the heat exchange media of the present invention.
Figure 2:
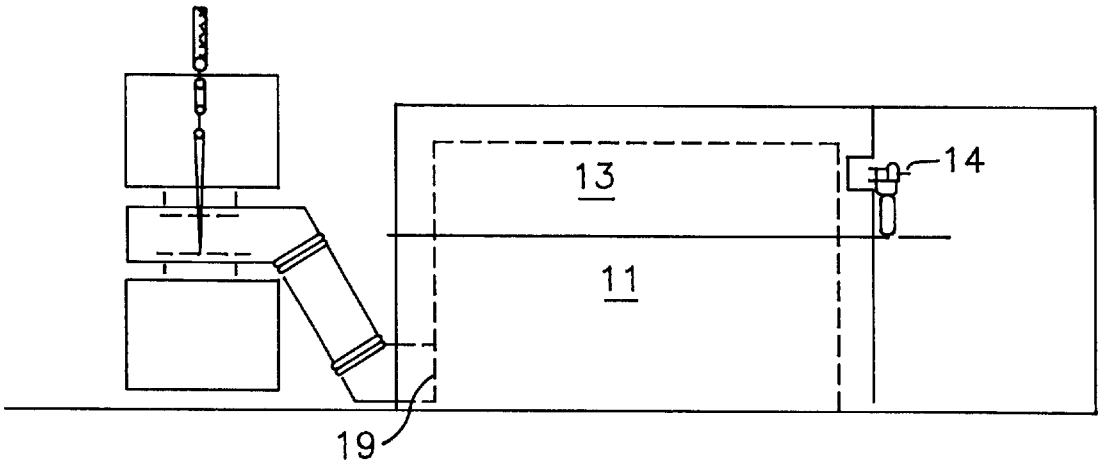
FIG. 2 is a side view of the apparatus of FIG. 1.

Turning first to FIGS. 1 and 2, there is shown a two column RTO utilizing the heat exchange media combination in accordance with the present invention. Gas to be treated such a process gas enters the inlet of the oxidizer at 10. Heat exchange columns 11 and 12 are positioned in communication with a combustion or oxidation chamber 13, the chamber 13 including heating means such as one or more burners 14 for heating the apparatus at least during start-up. Suitable valving, such as pneumatic poppet valves 15 and 15', preferably "double" poppet valves having a common center section, are associated with the inlet and outlet ducting of the heat exchange columns 11 and 12 and minimize leakage from the unit. An optional flush chamber 26 may be included in the apparatus to receive gases entrained in the valving and ductwork during a cycle.

Each heat exchange column 11, 12 contains a bed of heat exchange media that is a combination of randomly packed media and structured media. The amount (in terms of bed thickness) of the randomly packed media and the structured media depends upon cost, the heat recovery efficiency, and pressure drop desired. The combustion chamber 13 height is a function of flow; the combustion chamber should include 1 inch of height for every 500–600 scfm of process flow, and should be at least 24 inches high regardless of flow. The bed inlet/outlet plenum 19 is ½ the combustion chamber 13 height. The overall height of the unit is the sum of the bed height, the plenum height, the combustion chamber height and the insulation thickness (6 inches), and can be represented by the following formula:

$$\text{Height}=[\text{Flow}/370.4][\text{in/scfm}]+44\text{ in.}$$

where flow is the process flow in scfm, and the minimum height is 80 inches. The diameter of the beds is directly proportional to the $[\text{flow rate}]^{1/2}$.

Process gas is heated by direct contact with hot heat exchange materials to temperatures (typically in excess of 1500° F.) at which the VOCs are completely oxidized to carbon dioxide and water. If such heating is insufficient to increase process gas temperature above 1500° F., then supplemental heat may be added by, for example, electric heating elements or one or more burners 14 positioned in the combustion chamber. After the VOCs are oxidized, the process exhaust is cooled by direct contact with cooler heat exchange materials in the second heat exchange column now being used as the cooling column. Then the cleaned process gas exits to the atmosphere through a suitable exhaust stack 8. After continuous operation for a given amount of time (referred to as the "cycle time"), heat recovery efficiency suffers and the flow is switched with suitable valving, i.e., the now hotter column is used for heating and the now cooler column is used for cooling. In the case of a single column RTO, the direction of flow through the column is reversed by the valve system.

The heat exchange media used in such RTOs must be selected so that the RTO meets certain performance criteria.

Specifically, excessive pressure drop within the heat exchange columns deleteriously impacts the throughput, and would necessitate large pumps and high energy requirements. In addition, the heat exchange media should be suitably sized to as to allow for laminar flow, i.e., flow preferably having a Reynolds number less than about 4000, most preferably less than about 2300. It is therefore desirable that the heat exchange media be sufficiently large so as to avoid large pressure drops. However, the heat exchange media must not be too large so as to reduce specific surface area and thus heat transfer, thereby resulting in lost thermal efficiency of the RTO. In addition, monoliths used as heat exchange media are expensive, possibly not justifying the pressure drop advantage obtained by their use.

The present inventors have found that by using a multi-layer heat exchange media combination, such as a dual-layer combination, in accordance with the present invention, efficient and cost effective RTOs can be obtained without sacrificing performance.

Figure 3:
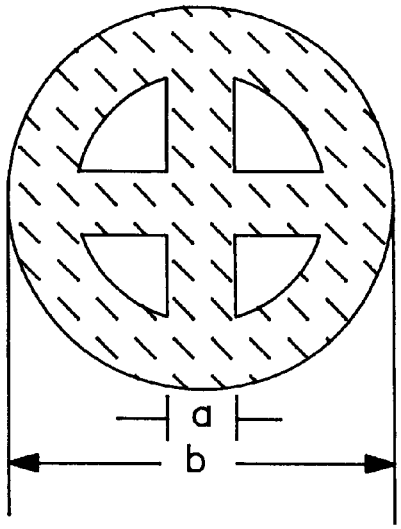
FIG. 3 is a cross-sectional view of a four-vaned heat exchange media particle according to a first embodiment of the invention.
Figure 5:
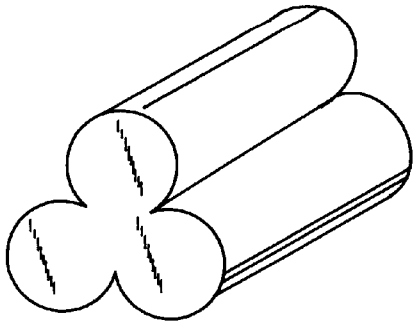
FIG. 5 illustrates a trilobe heat exchange media particle according to another embodiment of the invention.
Figure 6:
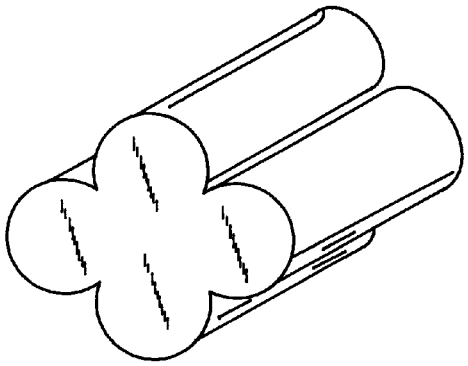
FIG. 6 illustrates a quadrilobe heat exchange media particle according to another embodiment of the invention.
Figure 7:
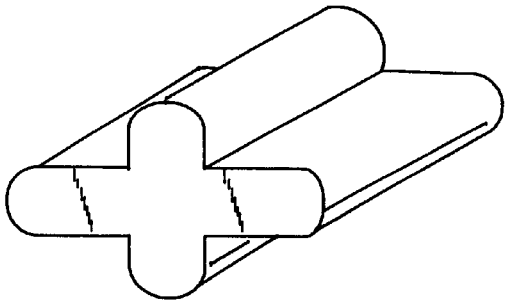
FIG. 7 illustrates a modified quadrilobe according to another embodiment of the invention.
Figure 9:
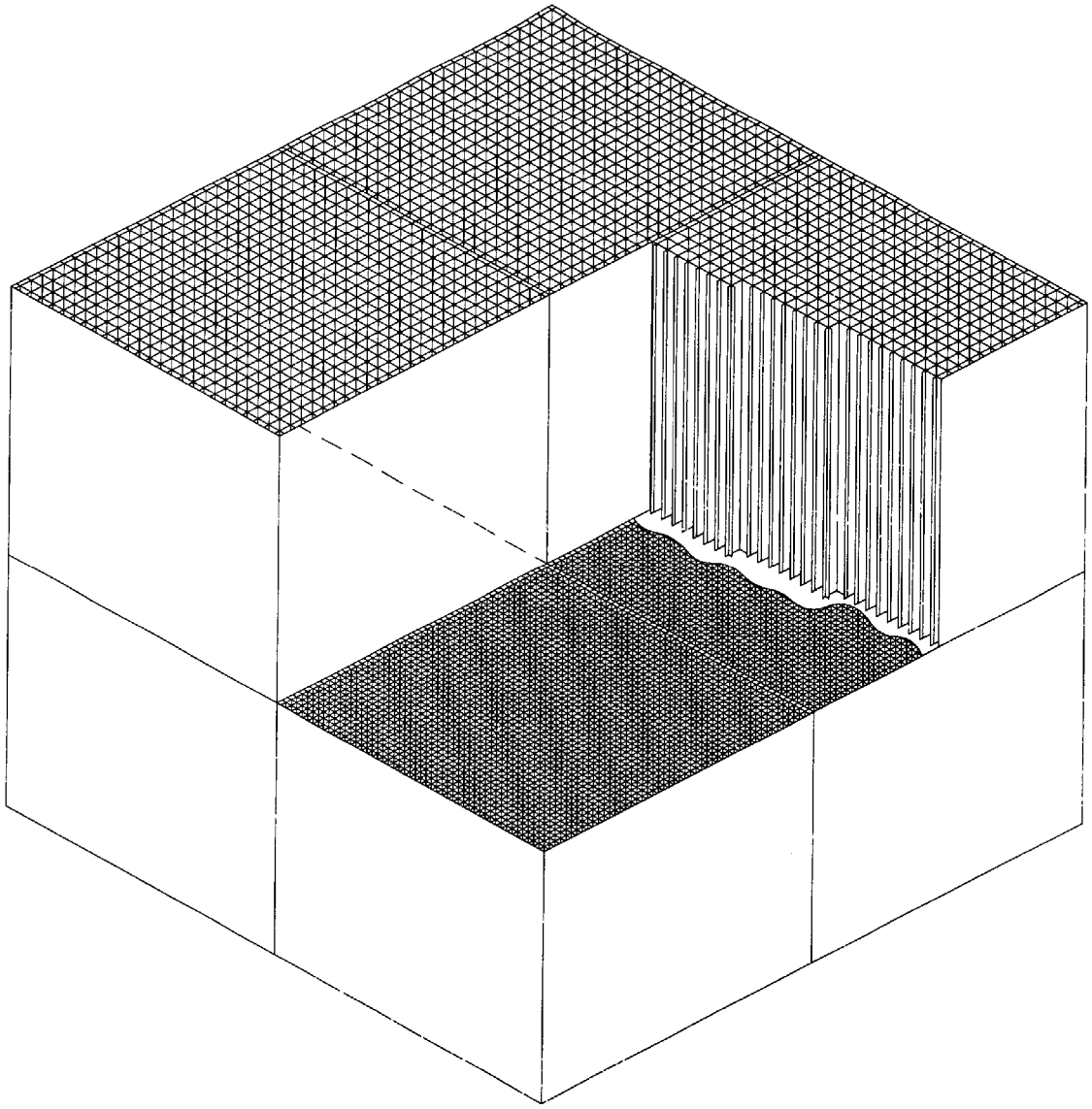
FIG. 9 is a perspective view of heat exchange media in accordance with one embodiment of the present invention.
Figure 10:
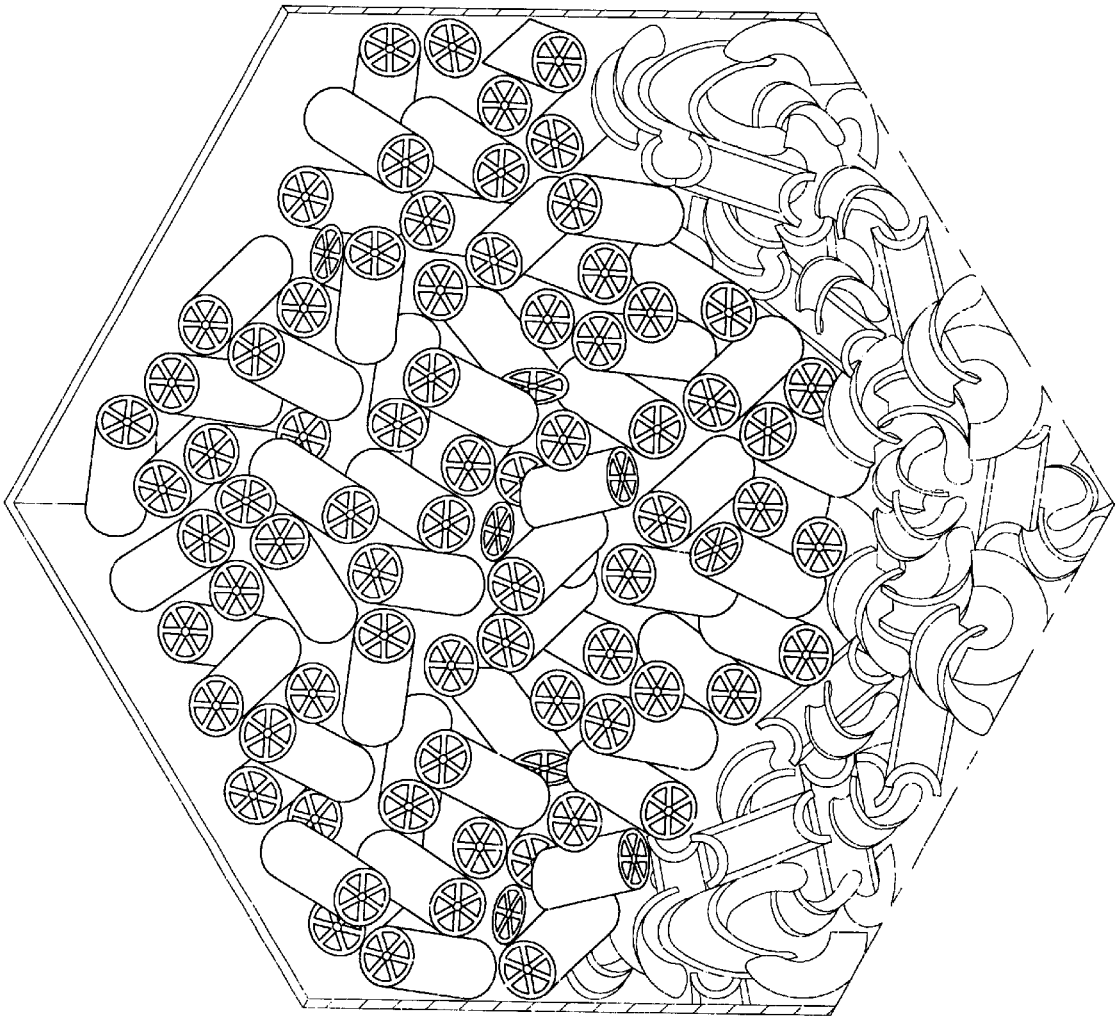
FIG. 10 is a perspective view of heat exchange media in accordance with another embodiment of the present invention.

In accordance with the present invention, a portion of the heat exchange media is randomly packed media, such as stones or saddles. In a particularly preferred embodiment, the randomly packed media is media that includes voids which allow the passage of gas through the media particles. The voids should be larger than the voids existing in the interstices formed amongst the media particles. If the voids are too small, the gas will tend to flow in the interstices rather than through the voids in the particles. These exchange particles according to the present invention are fabricated of a single material and are characterized by protrusions or vanes extending from the center of the particle. Spaces between the protrusions provide an ideal void fraction for the passage of gases, thereby improving the pressure drop characteristics of the aggregate heat exchanger bed. In a most preferred embodiment, the particles are in the form of wagon wheels, i.e., small tubular extruded members having a series of vanes which extend through the center of the axis of rotation of the tubular member. Viewed from the center, they appear as a series of ribs which extend out to the outer tubular element. The outer cylindrical wall provides additional strength to the particles and prevents intermeshing of the vanes of neighboring particles. This intermeshing may restrict the flow of gas through the bed due to the filling of voids between the vanes. In the embodiment shown in FIG. 3, there are four vanes or ribs and in the embodiment illustrated in FIG. 4, there are six vanes or ribs. Other embodiments are shown in FIGS. 5, 6, and 7. The width of the vanes are preferably smaller than the spacing between the vanes. This spacing creates the desirable void fraction of the aggregate bed packing thereby ensuring an adequate flow through the bed. The particles have substantially constant cross sectional shape, size, and area. Because the particles are used as a discontinuous aggregate bed packing, any thermal variation is localized and will not cause a significant decrease in the service life of the individual particles or the heat exchanger as a unit.

This unique geometry produces a structure having a large specific surface area and a large void fraction. The specific surface area is generally in the range of 0.1–50 $mm^2/mm^3$, and preferably 0.5–5 $mm^2/mm^3$. Because the particles are made of a high-temperature stable material which can withstand the high temperatures required for efficient destruction of VOCs, preferred materials of construction include aluminum silicate clays, such as kaolin, aluminum silicate clay mixed with alumina, or aluminum silicate clay and alumina mixed with silica and/or zeolites. Other candidate materials of manufacture include mullite, alumina, silica-alumina, zirconia, and generally any inorganic oxide materials or other materials stable up to about 1000° C. The materials should be dense and have a high heat capacity.

The overall diameter, b, can range in size from about 2 mm to about 50 mm, preferably 6–13 mm. In order to achieve optimum heat transfer and heat capacity while minimizing pressure drop, the size of the particles most preferably should be about 10 mm (0.375 inches).

Figure 4:
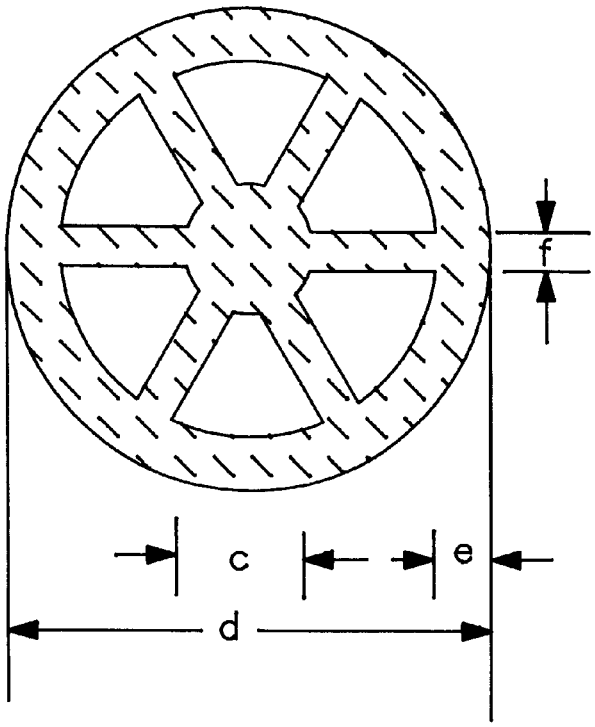
FIG. 4 is a cross-sectional view of a six-vaned heat exchange media particle according to a second embodiment of the invention.

In another embodiment in FIG. 4, a six-vaned particle is formed. Again, the overall diameter, d, can range in size from 2 mm up to about 50 mm, preferably 6–13 mm. A useful size particle with six vanes is the 0.21 inch size. In order to achieve optimum heat transfer and heat capacity while minimizing pressure drop, the size of the particles most preferably should be about 10 mm (0.375 inches). Again, the thickness of the vanes also can be varied.

In another embodiment, the die may be configured so that where the vanes come together they form a circular hub which has a diameter, c, which can be adjusted in size. The hub is an optional structural feature to provide additional crush strength for the particle. It can be used with either the four- or six-vaned embodiments.

The thickness of the wall of the particle, shown as "e" in FIG. 4, can also be varied. The thicker the wall, the stronger will be the particle in terms of crush strength.

The aspect ratio is the ratio of the length of the particle to its diameter. Aspect ratios can vary from 0.1–3 with generally preferred aspect ratios of 0.4–1.5.

Those skilled in the art will recognize that other suitable shapes for the randomly packed media of the present invention can be used, including gravel, saddles, etc. Preferably the saddles are ½"1" saddles, most preferably ½" saddles, such as those commercially available from Lantec Products, Inc.

In accordance with the present invention, another portion of the heat exchange media is a monolithic structure used in combination with the aforementioned randomly packed media. The monolithic structure preferably has about 50 cells/$in^2$, and allows for laminar flow and low pressure drop. It has a series of small channels or passageways formed therein allowing gas to pass through the structure in predetermined paths, generally along an axis parallel to the flow of gas through the heat exchange column. Suitable monolithic structures are mullite ceramic honeycombs having 40 cells per element (outer diameter 150 mm×150 mm) commercially available from Frauenthal Keramik A.G. In the preferred embodiment of the present invention, monolithic structures having dimensions of about 5.25"×5.25"×12.00" are preferred. These blocks contain a plurality of parallel squared channels (40–50 channels per square inch), with a single channel cross section of about 3 mm×3 mm surrounded by an approximately 0.7 mm thick wall. Thus, a free cross section of approximately 60–70% and a specific surface area of approximately 850 to 1000 $m^2/m^3$ can be determined. Also preferred are monolithic blocks having dimensions of 5.90"×5.90"×11.81".

In view of the high cost of monolithic structures, preferably only one monolithic layer is used, although those skilled in the art will appreciate that the single layer can be composed of a plurality of monolithic structures or blocks properly aligned so that respective flow passages communicate in the direction of gas flow. One suitable bed height is a monolithic layer of 12 inches plus 56.6 inches of ½ inch randomly packed saddles, for a total bed height of 68.6 inches. Another suitable bed height is a monolithic layer of 12 inches plus a Minilith layer of 26.2 inches, for a total bed height of 38.2 inches. A single layer of monolith with similar performance would require a bed height of 68 inches. Other suitable bed heights include monolithic layers of 24 inches plus ½ saddles 33.2 inches or Minilith media of 15.3 inches, a monolithic layer of 12 inches plus a Minilith media layer of 20 inches, and a monolithic layer of 18 inches and ½ saddles 42 inches deep. Either or both the randomly packed media and structured media may have a catalyst applied to its surface to enhance oxidation.

In a further embodiment of the present invention, the multi-layer heat exchange bed can consist of more than two distinct layers of media. For example, the randomly packed media at the inlet of a column can be a combination of different size saddles, such as a first layer of ½" saddles followed by a second layer of 1" saddles. The monolithic layer would then follow towards the outlet of the column. Similarly or in addition, the monolithic layer could be e.g., a first layer of monoliths having channel cross-sections of 3 mm×3 mm, followed by a second layer of monoliths having channel cross-sections of 5 mm×5 mm. In a system where only a single heat exchanger column is used, the multi-layer media bed can be a first layer of randomly packed media, a second layer of monolithic media, and a third layer of randomly packed media. Those skilled in the art will appreciate that the particular design of the multi-layer bed depends on desired pressure drop, thermal efficiency and tolerable cost.

Figure 8:
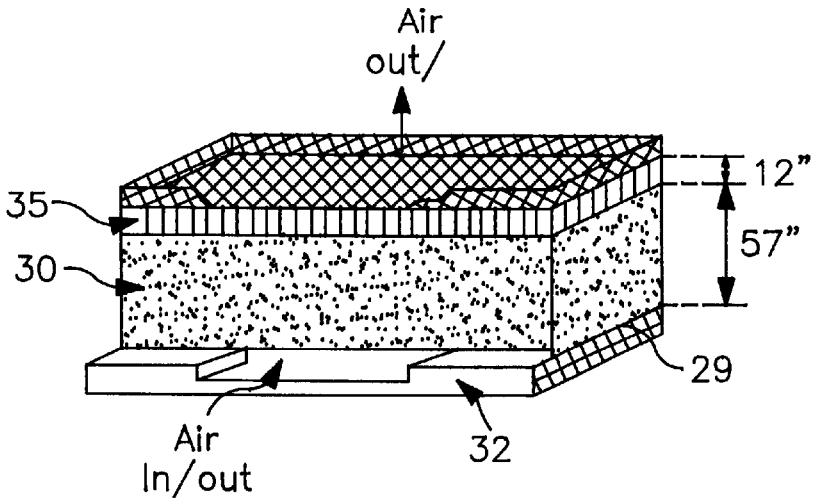
FIG. 8 is a perspective view of one embodiment of a bed of randomly packed media and structured media in accordance with the present invention.

Turning now to FIG. 8, the relatively high flow resistant randomly packed portion 30 of the media is supported on support 29 and is preferably placed by the inlet of the heat exchanger column so that the process gas to be treated enters the heat exchange column (at 32) and contacts the randomly packed media 30 first, thereby effectively assisting in distribution of the gas across the column cross section. The relatively low flow resistant monolithic portion 35 of the media is preferably placed by the outlet of the heat exchanger column, on the top of the randomly packed media 30, where gas distribution has already occurred. Inside an regenerative bed, the exiting section of the bed has higher fluid temperatures than the inlet section. Higher temperature means both increased gas viscosity and increased actual velocity of the fluid, which then generate an elevated pressure drop. Thus, use of the structured media, which has an inherently lower pressure drop, in this portion of the column is advantageous. In the embodiment of FIG. 8, the randomly packed media 30 is 57 inches deep, and the structured media 35, which consists of a single layer of a plurality of monolithic blocks, is 12 inches deep.

A further advantage of the present invention using a combination of randomly packed media 30 and structured media 35 is in applications where the heat exchange columns are horizontally oriented; i.e., the flow of process gas through the columns is horizontal relative to the ground. The randomly packed portion of the media enhances process gas distribution in the column, and the defined passageways in the structured media help eliminate the deleterious effects of gravity that would otherwise cause the gas to accumulate as it proceeds towards the column exit in such horizontally oriented columns.

In operation, solvent laden air is directed into the base of an energy recovery column which is on an inlet mode, by passing through a main exhaust fan (not shown), inlet ductwork, and valve 15 (or 15', as the case may be). The solvent laden air is then directed into a heat exchange column 11, and through the multi-layer bed (such as a dual layer) of heat exchange media contained therein. Heat is transferred from the hot heat exchange media to the cooler solvent laden air, so that by the time this air exits the opposite end of the column of media, it has been heated to the operating temperature (or set-point) or close to the operating temperature of the oxidizer. Burner means associated with the combustion chamber 13 can assist in raisin(, the air to the set-point temperature where necessary, and oxidation of the VOCs, which was begun in the heat exchange media, is completed if necessary. The hot, now purified air then passes through the multi-layer bed of heat exchange media in the other heat exchange column, and the hot air heats the cooler media therein so that by the time the air exits the opposite end of this second column, it has been cooled to an acceptable temperature, such as a temperature only slightly higher than that of the incoming solvent laden air.

At periodic intervals, flow through the oxidizer is reversed by simultaneously actuating both poppet valves 15, 15'. The poppet valves continuously cycle so that one energy recovery column is always in an outlet or gas cooling mode. The frequency of the flow reversals is directly related to the volumetric flow through the oxidizer, and can be readily determined by those skilled in the art.

When high destruction efficiencies, such as efficiencies of up to 99% are required, an optional flush control chamber can be used. The flush control chamber includes an associated valve 25 (preferably a poppet valve), flush chamber 26 and associated duct work. Prior to flow reversal, the flush control poppet valve 25 will change positions to direct the normal exhaust from the oxidizer into the storage chamber 26. When a flow reversal occurs on the oxidizer, the "puff" of VOC laden air that normally would be released to atmosphere is stored in the flush control chamber 26. After a flow reversal is completed, the normal exhaust from the oxidizer continues to flow into the flush control chamber 26 to capture any residual VOC laden air from the base of the energy recovery columns and ductwork. The flush poppet valve 25 then switches position and the normal exhaust is directed to the exhaust stack 8 while the VOC laden air stored in the flush chamber 26 is slowly drawn back into the inlet of the oxidizer.

If a catalyst is to be carried by the particles, a washcoat of alumina should be applied to the particle prior to the catalyst. Useful catalysts are generally any VOC oxidation catalyst, such as platinum or palladium. However, catalysts consisting of various blends of metal oxides also can be used.

EXAMPLE 1

This example illustrates the pilot scale preparation of 0.21" six spoke particle extrudates composed of silica and alumina. Catapal B alumina (27.2 lbs.) was placed in a 50-gallon Sigma mixer followed by addition of 50.0 lbs. water and 4.76 lbs nitric acid and mixed for 60 minutes until a homogeneous gel was formed. While the mixer was running, 130.7 lbs. of Davison non-promoted fluid catalytic cracking catalyst (composed primarily of silica and alumina) was added to the gel, and the resulting mixture was again mixed to homogeneity (about 10 minutes). While mixing, 6.50 lbs. of Methocel K4M was added and mixing was continued for 10 minutes. An additional 25 lbs. of water and 2.08 lbs. of Methocel K4M were added followed by 27 minutes of mixing. The resultant paste was extruded into 0.21" pellets. The pellets were dried at 80° C., and calcined at 1200° C. for 6 hours.

EXAMPLE 2

This example illustrates the lab scale preparation of 0.25" six spoke particle extrudates using mullite. Catapal C alumina (30.0 lbs) was placed in a 50-gallon Sigma mixer followed by the addition of 5.3 lbs nitric acid (70 wt %) in 70.0 lbs. of water and mixed for 40 minutes until a homogeneous gel was formed. While the mixer was running, 300 lbs. of mullite was added to the gel and the mixture was blended for 10 minutes. Methocel K4M (15.0 lbs.) was added and mixing was continued for 5 minutes. An additional 10.0 lbs. of water was added followed by an additional 5 minutes of mixing. A portion of the resultant paste (16.5 lbs.) was transferred to a 5-gallon Sigma mixer where 3.3 lbs. mullite powder was added and the mixture blended for 15 minutes. The finished paste was extruded into 0.25" six spoke pellets. The pellets were dried at 80° C., and calcined at 600° C. for 8 hours followed by further calcination at 1400° C. for 6 hours.

A significant advantage of these ribbed particles over conventional spheres is their ability to provide both a large geometric surface area per packed volume of reactor and to provide a lower pressure drop across the bed than is obtained by spheres having a comparable geometric surface area per packed volume.

EXAMPLE 3

The performance of heat exchange media was studied in a special pressure drop and heat transfer apparatus. The vessel of this apparatus contained a column of the heat exchanger media that was held in an impermeable cylinder and surrounded by insulation packed in an outer metal shell. Prior to the pressure drop and heat transfer measurements, a constant volumetric flow of hot fluid was determined by orifice measurements and pulled through the column of heat exchange media. The hot fluid stream was generated by mixing atmospheric air with the hot flue gases of a burner. Two thermocouples and two pressure taps were placed in the bottom and the top of the bed on the vessel's center line. There the static pressures and the temperatures of the air flow were continuously measured and recorded.

After the total media column reached a steady-state temperature, the burner was disabled. Thus, only atmospheric air flowed through the bed and cooled it. The cool-down temperatures and pressures were then recorded. With a simulation program that was adjusted on the geometry of the heat exchanger bed, the specific geometry of the heat exchanger media, the properties of the media and the fluid, etc., the measured data were analytically reproduced. After the successful modelings of the actual measurements, the characteristic data for further pressure drop and heat transfer calculations were noted. Table 1 shows a comparison of three different heat exchange bed designs under the same conditions ($T_{in}$=100° F., $T_{chamber}$=1600° F., $\tau_{switch}$= 180 sec.):

TABLE 1

| | Structured Media in Single-Layer Bed | Randomly Packed Media in Single-Layer Bed | Combined Media in Dual-Layer Bed |
|---|---|---|---|
| V (scfm) | 20,000 | 20,000 | 20,000 |
| $v_{max}$ (sfpm) | 400 | 200 | 200 |
| $H_{bed}$ (in.) | 68 | 80 | 68.6 |
| $V_{bed}$ ($ft^3$) | 283 | 667 | 572 |
| $\epsilon_{HX}$ (%) | 93.9 | 94.0 | 94.0 |
| $\Delta p_{2\text{-}bed}$ (%) | 100 | 163 | 110 |
| Media Cost (%) | 100 | 60 | 78 |

It will be apparent to those skilled in the art that various modifications and variations can be made in the disclosed process and product without departing from the scope or spirit of the invention. Other embodiments of the invention will be apparent to those skilled the art from consideration of the specification and practice of the invention disclosed herein. It is intended that the specification and examples be considered as exemplary only, with a true scope and spirit of the invention being indicated by the following claims.

What is claimed is:

1. A heat exchanger comprising:

a heat exchanger column having an inlet for receiving a flow of gas, said column comprising a bed of packing material, said packing material being formed of a heat resistant, heat retaining material and being comprised of (a) randomly packed heat exchange media, and (b) structured media comprising one or more blocks comprising a plurality of gas flow channels therethrough arranged along an axis parallel to the flow of said gas, wherein the flow of gas through said gas flow channels is laminar.

2. The heat exchanger of claim 1, wherein said randomly packed heat exchange media comprises a first layer of particles having a first average size and a second layer of particles having a second average size larger than said first average size.

3. The heat exchanger of claim 1, wherein said structured media comprises a first monolithic layer having gas flow channels with a first cross-sectional area and a second monolithic layer having gas flow channels with a second cross-sectional area larger than said first cross-sectional area.

4. The heat exchanger of claim 1, wherein said randomly packed media comprises particles sufficiently small so as to allow for laminar flow of gas passing through said heat exchange column.

5. The heat exchanger of claim 1, wherein said packing material is formed essentially of material selected from the group consisting of aluminum-silicate clay, aluminum-silicate clay mixed with alumina, and aluminum-silicate clay mixed with alumina and at least one of silica and zeolite.

6. The heat exchanger of claim 1, wherein said randomly packed media comprises particles having voids larger than the interstices formed between said particles.

7. The heat exchanger of claim 6, wherein said particles comprise vanes extending from the center of the particle.

8. The heat exchanger of claim 7, wherein said particles have at least four vanes.

9. The heat exchanger of claim 7, wherein said particles have at least three vanes.

10. The heat exchanger of claim 7, wherein said particles have at least two vanes.

11. The heat exchanger of claim 1, wherein said randomly packed media is a plurality of saddles.

12. The heat exchanger of claim 1, wherein either of both of said randomly packed media and structured media have a catalyst applied to their surface.

13. A regenerative thermal oxidizer comprising:

at least one heat exchange column containing heat-exchange media;

a combustion chamber in communication with said at least one heat exchange column;

gas inlet and outlet means in communication with said at least one heat exchange column;

wherein said heat exchange media is formed of heat resistant, heat retaining material and comprises at least one layer consisting essentially of a plurality of particles and at least one layer consisting essentially of structured media comprising one or more blocks comprising a plurality of gas flow channels therethrough arranged along an axis parallel to the flow of said gas, wherein the flow of gas through said gas flow channels is laminar.

14. The regenerative thermal oxidizer of claim 13, wherein said heat exchange media further comprises a second layer of a plurality of particles.

15. The regenerative thermal oxidizer of claim 13, wherein said heat exchange media further comprises a second layer of structured media.

16. The regenerative thermal oxidizer of claim 13, wherein each of said particles are sufficiently small so as to allow for laminar flow of gas flowing therethrough in said at least one heat exchange column.

17. The regenerative thermal oxidizer of claim 13, further comprising at least two heat exchange columns.

18. The regenerative thermal oxidizer of claim 13, wherein each of said particles is from about 6 to about 13 mm in size.

19. The regenerative thermal oxidizer of claim 13, wherein each of said particles has voids larger than the interstices formed between said particles.

20. The regenerative thermal oxidizer of claim 13, wherein each of said plurality of particles are saddles.

21. The regenerative thermal oxidizer of claim 13, wherein said at least one heat exchange column comprises an inlet end for receiving gas and an outlet end in communication with said combustion chamber, and wherein said at least one layer of a plurality of particles is at said inlet end and said at least one layer of structured media is at said outlet end.

22. The regenerative thermal oxidizer of claim 13, wherein either or both of said plurality of particles and said structured media have a catalyst applied to their surface.

* * * * *